US006468634B1

(12) United States Patent
Miyake et al.

(10) Patent No.: US 6,468,634 B1
(45) Date of Patent: Oct. 22, 2002

(54) HEAT TRANSFER SHEET

(75) Inventors: Kazuhito Miyake, Shizuoka-ken (JP); Akihiro Shimomura, Shizuoka-ken (JP); Akira Hatakeyama, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/448,603

(22) Filed: Nov. 24, 1999

(30) Foreign Application Priority Data

Dec. 1, 1998 (JP) ..... 10-341675
Sep. 22, 1999 (JP) ..... 11-269343

(51) Int. Cl.[7] ..... B41M 5/26
(52) U.S. Cl. ..... 428/195
(58) Field of Search ..... 428/195, 484, 428/488.1, 488.4, 327, 409

(56) References Cited

U.S. PATENT DOCUMENTS 4,772,582 A 9/1988 Deboer ..... 503/227
4,826,717 A * 5/1989 Kohashi et al.
4,876,235 A 10/1989 Deboer ..... 503/227

FOREIGN PATENT DOCUMENTS

JP 5-169861 7/1993 ..... B41M/5/40
JP 6-79980 3/1994 ..... B41M/5/40

* cited by examiner

*Primary Examiner*—Pamela R. Schwartz
(74) *Attorney, Agent, or Firm*—Sughrue Mion, PLLC

(57) ABSTRACT

The present invention relates to a heat transfer sheet in which at least an ink layer is provided on a substrate. In the heat transfer sheet of the present invention, as an intermediate layer provided between the substrate and the ink layer contains an appropriate amount of particu+late material having the function of forming unevenness on the surface of the ink layer, without containing the particulate material in the ink layer, a 10-point mean surface roughness (Rz) of the surface of the ink layer can be 0.5~5.0 $\mu$m. Namely, in accordance with the heat transfer sheet of the present invention, without a matte agent which may affect the image quality being used in the ink layer, the vacuum adhesion uniformity between the heat transfer sheet and an image receiving sheet at the time of heat-transfer can be ensured and an image with high quality can be formed.

13 Claims, No Drawings

HEAT TRANSFER SHEET

BACKGROUND OF THE INVENTION

1. Field of the Invention

The present invention relates to a heat transfer sheet used in an image forming process in which an image with a high resolution is formed by using a thermal head or a laser light.

2. Description of the Related Art

As an image recording process by heat-transfer, conventionally, a process in which a heat transfer sheet is directly pressed and heated by a thermal head is in widespread use. This process has some superior characteristics in that it is able to be performed at a low noise level using a simple device structure, maintenance is not necessary, and the process is a dry processing. Recently, the densification of the thermal head itself has been improved. In the above process, it is possible to obtain images whose resolution has been increased to a high level.

As an image recording process by heat-transfer which is able to record images with higher resolutions, a laser heat transfer recording process has been known in which a laser light is irradiated onto the heat transfer sheet, the laser light is converted into heat in the heat transfer sheet and thus recording is carried out by the heat. In the above described process, because laser light serving as an energy supply source can be condensed to a few microns, it is possible to improve resolutions significantly compared with the process using the thermal head.

As the heat transfer sheet used in a laser heat transfer recording process, a heat-fusing transfer sheet (described in Japanese Patent Application Laid-Open (JP-A) No. 5-58,045 and the like) is known, which comprises, on a substrate, a light-to-heat conversion layer which absorbs the laser light and generates heat, and an image forming layer in which pigment is dispersed in a component such as a heat-fusing wax, a binder or the like in that order. When the above-described heat-fusing transfer sheet is used, the image forming layer corresponding to a laser light illuminating region of the light-to-heat conversion layer is fused by heat generated in the laser light illuminating region, and is transferred to an image receiving sheet superimposed on the heat-fusing transfer sheet. As a result, a transferred images formed on the image receiving sheet.

JP-A No. 6-219,052 disclosed an image forming process in which a heat transfer sheet is used for forming highly detailed image on the image receiving sheet which is superimposed upon the heat transfer sheet In the heat transfer sheet, a light-to-heat conversion layer containing a heat-to-light conversion material, a very thin (0.03–0.31 $\mu$m) heat peeling layer and an image forming layer containing a color material are disposed in that order on a substrate, and the bonding strength between the image forming layer and the light-to-heat conversion layer bound together due to the heat peeling layer therebetween is weakened by the irradiation of laser light. In this image forming process, so called "abrasion" is utilized. Specifically, in a region illuminated with the laser light, the heat peeling layer is partially decomposed and vaporized. As a result, the adhesion between the image forming layer and the light-to-heat conversion layer is weakened so that the image forming layer in the illuminated region is transferred to the image receiving sheet superposed on the heat transfer sheet and the transferred image is formed on the image receiving sheet.

The image forming process utilizing laser light has advantages in that it is able to use printing paper provided with an image receiving layer (an adhesive layer) serving as the image receiving sheet, a multi-color image can be easily formed by transferring sequentially different color images onto the image receiving sheet and the like. In particular, the image forming process utilizing abrasion has an advantage in that highly detailed images can be easily formed.

In these image forming methods using heat transfer, because the adhesion between the heat transfer sheet and the image receiving sheet when the image is transferred affects considerably the resolution of the image, the key to obtaining an image with high resolution is enhancing the adhesion between the heat transfer sheet and the image receiving sheet As a method for enhancing the adhesion between the heat transfer sheet and the image receiving sheet, there may be proposed a method in which the heat transfer sheet and the image receiving sheet are superimposed with each other, and are wound onto a cylindrical drum having a plurality of through holes. The pressure inside the cylindrical drum is then reduced such that the adhesion between the heat transfer sheet and the image receiving sheet is enhanced. However, in this process, air is accumulated between the heat transfer sheet and the image receiving sheet and the sheets becomes wavy. As a result, complete adhesion of the sheets may be rather inhibited. Therefore, in order to solve the problems such as air accumulation and the like, particulate material, having a particle size of several $\mu$m to several tens of $\mu$m, which is referred to as a matte agent, is added to surface layers of the heat transfer sheet and/or the image receiving sheet which face each other so that the surface of the heat transfer sheet and/or the image receiving sheet is made uneven. By this method, problems such as air accumulation are solved and vacuum adhesion uniformity between the sheets can be ensured.

However, when the matte agent is added to the surface layer of the heat transfer sheet, problems such as image voids may be generated and at the same time the hue of formed images may be affected so that images having good hues cannot be formed. On the other hand, when the matte agent is added to the surface layer of the image receiving sheet, there may be cases in which image voids are generated.

SUMMARY OF THE INVENTION

Therefore, an object of the present invention is to provide a heat transfer sheet which can ensure vacuum adhesion uniformity between the heat transfer sheet and an image receiving sheet at the time of heat-transfer and form images with high quality without using a matte agent which may affect the image quality in an ink layer.

In order to accomplish the above-described object, the present invention has the characteristics given below.

In accordance with a first aspect of the present invention, there is provided a heat transfer sheet which comprises a substrate, and an ink layer which is provided on the substrate and contains a pigment and an amorphous organic polymer, wherein the ink layer is structured such that, no particulate material having the function of forming unevenness of the surface of the ink layer is used in the ink layer, and the 10-point mean surface roughness (Rz) of the surface of the ink layer is 0.5~5.0 $\mu$m.

In accordance with a second aspect of the present invention, an intermediate layer, containing a particulate material having the function of forming unevenness on the surface of the ink layer, is provided between the substrate and the ink layer.

In accordance with a third aspect of the present invention, the thickness of the intermediate layer portions, where no particulate material which has the function of forming unevenness on the surface of the ink layer is present, is smaller than the number average particle diameter of the particulate material.

In accordance with a fourth aspect of the present invention, the number average particle diameter of the particulate material is 0.5 μm or more, and the ink layer contains a wax.

In accordance with a fifth aspect of the present invention, the weight ratio (W:P) of the content of the wax (W) to the content of the amorphous organic polymer (P) in the ink layer is 5:100~100:100.

In accordance with a sixth aspect of the present invention, the number average particle diameter of the particulate material is 0.6~4.0 μm.

In accordance with a seventh aspect of the present invention, the content of the particulate material in the intermediate layer is 5~100 mg/m$^2$.

In accordance with an eighth aspect of the present invention, the particulate material is organic particulates.

In accordance with a ninth aspect of the present invention, the entire heated ink layer is transferred during heat-transfer.

In accordance with a tenth aspect of the present invention, the intermediate layer contains a material having a light-to-heat conversion function.

In accordance with an eleventh aspect of the present invention, a cushion layer is disposed between the substrate and the intermediate layer and the thickness of the cushion layer is 1~30 μm.

DESCRIPTION OF THE PREFERRED EMBODIMENTS

The heat transfer sheet of the present invention comprises at least an ink layer provided on a substrate wherein the ink layer does not contain a particulate substance having the function of forming unevenness on the surface of the ink layer. In addition, the 10-point mean surface roughness of the surface of the ink layer is between 0.5~5 μm. Moreover, an intermediate layer, a cushion layer, or a heat-sensitive peeling layer may be provided where necessary either singly or in combination between the substrate and the ink layer in the heat transfer sheet of the present invention. A light reflux prevention layer may also be provided on the surface of the substrate opposite to that on which the ink layer is provided. Further, an image receiving sheet may also be superposed where necessary on the ink layer of the heat transfer sheet of the present invention.

A preferred embodiment of a heat transfer sheet of the present invention will be described in detail hereinafter with the explanation devided into a plurality of sections describing the substrate, ink layer, other layers which are provided as occasion demands, and the image receiving sheet. Also, an image forming method using the heat transfer sheet of the present invention will be described.

Substrate

The material for the substrate is not particularly limited. Therefore, various materials can be used in accordance with purposes. Preferred examples of the material for the substrate include synthetic resins such as polyethylene terephthalate, polyethlene-2,6-naphthalate, polycarbonate, polyethylene, polyvinyl chloride, polyvinylidene chloride, polystyrene, and styrene/acrylonitrile copolymers and the like. Among these materials, biaxial oriented polyethylene terephthalate is preferable from its mechanical strength and dimensional stability with respect to heat When the heat transfer sheet of the present invention is used in a laser heat transfer recording method, the substrate of the heat transfer sheet is preferably made from a transparent, laser light-transmitting synthetic resin.

In order to improve the adhesion between the substrate of the heat transfer sheet and the layer provided on the substrate (i.e., an ink layer, an intermediate layer or a cushion layer), it is preferable to carry out a surface activation treatment of the substrate and/or to apply one layer or two or more layers of a primer to the substrate. Examples of the surface activation treatment include a glow discharge treatment, a corona discharge treatment, and the like. Materials for the primer preferably have good adhesion to the surfaces of both the substrate and the light-to-heat conversion layer, low thermal conducfivity and excellent heat resistance. Examples of such materials for the primer include styrene, a styrene/butadiene copolymer, gelatin and the like. The total thickness of the primer layer is generally 0.01 μm~2 μm.

Ink layer

In the heat transfer sheet of the present invention, an ink layer may be provided directly on the substrate. Alternatively, the ink layer may be provided with at least one of the intermediate layer, the cushion layer and the heat-sensitive peeling layer being interposed between the substrate and the ink layer when necessary. The ink layer contains a pigment, an amorphous organic polymer and optionally other components.

(Pigments)

Pigments can divided roughly into organic pigments and inorganic pigments. Organic pigments provide highly transparent films, while inorganic pigments are generally excellent in concealability. When the heat transfer sheet of the present invention is used for printing color correction, organic pigments are suitably used whose hues are identical or close to the yellow, magenta, cyan, and black which are generally used in printing ink. In addition to these pigments, metal powders, fluorescent pigments, and the like may also be used. Examples of the pigments suited for use in the heat transfer sheet include azo-based pigments, phthalocyanine-based pigments, anthraquinone-based pigments, dioxazine-based pigments, quinacridone-based pigments, isoindolinone-based pigments, and nitro-based pigments. Typical pigments according to hue are shown below.

1) Yellow Pigments

Hansa Yellow G, Hansa Yellow 5G, Hansa Yellow 10G, Hansa Yellow A, Pigment Yellow L, Permanent Yellow NCG, Permanent Yellow FGL, Permanent Yellow HR;

2) Red Pigments

Permanent Red 4R, Permanent Red F2R, Permanent Red FRL, Lake Red C, Lake Red D, Pigment Scarlet 3B, Bordeaux 5B, Alizarin Lake, Rhodamine Lake B;

3) Blue Pigments

Phthalocyanine Blue, Victoria Blue Lake, Fast Sky Blue;

4) Black Pigments

Carbon black.

In the present invention, the ink layer includes preferably 30~70% by weight and more preferably 40~60% by weight of pigments.

(Amorphous Organic Polymer)

Examples of the amorphous organic polymer included in the ink layer of the heat transfer sheet of the present invention and preferably having a softening point from 40 to 150° C., include, for example, butyral resins; polyamide resins; polyethyleneimine resins; sulfonamide resins; polyesterpolyol resins; petroleum resins; homopolymers or copolymers of styrene, derivatives or substituents thereof, such as styrene, vinyltoluene, α-methylstyrene, 2-methylstyrene, chlorostyrene, vinyl benzoate, soda vinylbenzenesulfonate, aminostyrene, and the like; homopolymers or copolymers of methacrylic esters such as methyl methacrylate, ethyl methacrylate, butyl methacrylate, hydroxyethyl methacrylate and methacrylic acid, acrylic esters such as methyl acrylate, ethyl acrylate, butyl acrylate, and α-ethylhexyl acrylate and the like and acrylic acid, dienes such as butadiene and isoprene and the like, acrylonitrile, vinyl ethers, maleic acid, maleic esters, maleic anhydride, cinnamic acid, vinyl monomers like vinyl chloride, vinyl acetate and the like. These resins may be used as mixtures of two or more resins.

In the present invention, the ink layer contains preferably 70%~30% by weight and more preferably 60~40% by weight of amorphous organic polymers.

(Wax)

A wax is preferably contained in the ink layer of the heat transfer material of the present invention.

Examples of the wax include a solid or semi-solid wax having a melting point of 40~160° C., for example, plant waxes such as Camauba wax, Japan wax and the like; animal waxes such as bees wax, whale wax and the like; oil waxes such as paraffin wax, polyethylene wax and the like; mineral waxes such as montan wax and the like; higher fatty acids such as behenic acid, stearic add and the like; higher alcohols such as palmityl alcohol, stearyl alcohol and the like; higher fatty acid esters such as cetyl palmitate and the like; higher fatty acid amides such as amide palmitate and the like; higher amines such as stearyl amine and the like.

Among these waxes, higher fatty adds and higher fatty add amides are preferable.

The weight ratio of the content of the wax (W) to the content of the amorphous organic polymer (P) in the ink layer (i.e., (W:P)) is preferably 5:100~100:100 and more preferably 10:100~70:100.

When the content of the wax (W) is too small, the transfer ability during heat-transfer deteriorates due to the particulate material contained in the intermediate layer so that sufficient image density cannot be obtained. When the content of the wax is too large, the adhesion resistance is decreased, and when the heat transfer materials are stored in a stacked manner, the ink layer may be transferred so that the image defects may be caused in the formed image.

(Other Components)

With the heat transfer sheet of the present invention, when the multi-color image is formed by superposing repeatedly multiple image layers (ink layers in which the images have been produced) on the same image receiving sheet, the ink layer preferably contains a plasticizer in order to enhance the adhesion between images. Examples of the plasticizer include phthalic esters such as dibutyl phtalate, di-n-octyl phthalate, di-(2-ethylhexyl) phthalate, dinonyl phthalate, dilauryl pthalate, butyl lauryl pthalate, butyl benzyl phthalate and the like; aliphatic dibasic acid esters such as di-(2-ethylhexyl) adipate, di-(2-ethylhexyl) sebacate, and the like; phosphoric triesters such as tricresyl phosphate, tri-(2-ethylehexyl) phosphate and the like, polyol polyesters such as polyethylene glycol ester and the like; and epoxy compounds such as epoxy fatty acid ester and the like. In addition to the above conventional plasticiziers, acrylic esters such as polyethylene glycol dimethacrylate, 1,2, 4butanetriol trimethacrylate, trimethylolethane triacrylate, tenpaerythrite triacrylate, pentanerythrite tetraacrylate, dipentaerythrite-polyacrylate may be suitably used in accordance with the type of binder employed. These plasticizers may be used as mixtures of two or more plasticizers.

Generally, the plasticizer is used in the ink layer such that the weight ratio of the total amount of the pigment and the amorphous organic polymer to the amount of plasticizer is 100:1~100:3, and preferably 100:1.5~100:2. In addition to the above-mentioned components, a surfactant, a thickener and the like may be added to the ink layer as occasion demands. The thickness (dry layer thickness) of the ink layer is preferably 0.2~1.5 μm, and more preferably 0.3~1.0 μm.

In the heat transfer sheet of the present invention, it is necessary to ensure vacuum adhesion uniformity of the ink layer with the image receiving sheet by making the surface of the ink layer uneven to a certain degree. The degree of unevenness of the surface of the ink layer is represented by a 10-point mean surface roughness (Rz) and must be 0.5 μm~5.0 μm and preferably 0.5 μm~3.0 μm, and more preferably 1.0 μm~2.5 μm. When the 10-point mean surface roughness of the ink layer is below 0.5 μm, the vacuum adhesion uniformity thereof with the image receiving sheet is insufficient, which is not preferable. On the other hand, when the 10-point mean surface roughness is more than 5.0 μm, the tight adhesion to the image receiving sheet is lost and may lead to transfer unevenness, which is not preferable.

The 10-point mean surface roughness (Rz) is defined in JIS B0601 and is easily measured by a stylus type surface roughness tester, for example, surfcom 570A 3DF (manufactured by Tokyo Seimitsu Co. Ltd.).

The method for turning the surface of the ink layer into the state prescribed in the present invention is not especially limited. For example, a method in which the surface of the ink layer is embossed and a method in which an intermediate layer containing particulate material having the function of making the surface of the ink layer uneven, i.e., a matte agent, is interposed between the substrate and the ink layer may be used. Among these methods, the method in which an intermediate layer, which contains the particulate material having the function of making the surface of the ink layer uneven, is interposed between the substrate and the ink layer, is preferable. The specific structure of the method of providing the intermediate layer will be described hereinafter.

Intermediate Layer

In the heat transfer sheet of the present invention, the intermediate layer can be provided between the substrate and the ink layer. The intermediate layer can be made so as to have one of or both of the functions described below: 1) the function in which the particulate material (matte agent) is contained in the intermediate layer as described above and the surface of the ink layer formed on the intermediate layer is made uneven as determined in the present invention (the unevenness-forming function); and 2) the function in which the light-to-heat conversion material is contained in the intermediate layer so that the energy from laser light is converted into heat, and therefore, the heat transfer of the ink layer becomes possible (the light-to-heat conversion function). A description will be given hereinafter of materials necessary for the above functions and of 3) a method of forming the intermediate layer.

1) Material Necessary for Unevenness-Forming Function (Particulate Material (Matte agent))

As particulate material, inorganic particles or organic particles can be used. Organic particles are particularly preferable because they do not precipitate in the solvent due to their relatively small specific gravity and have good coating liquid stability. Specific inorganic particles include metallic salts of silica, titanium oxide, aluminum oxide, zinc oxide, magnesium oxide, barium sulfate, magnesium sulfate, aluminum hydroxide, magnesium hydroxide, boron nitride, and the like, and kaolin, clay, talc, zinc white, white lead, quartz, diatomaceous earth, perlite, bentonite, mica, synthetic mica and the like.

Specific examples of organic particles include resin particulates such as fluorocarbon resin particulates, PMMA particulates, polystyrene (PS) resin particulates, polyethylene (PE) resin particulates, guanamine resin particulates, benzoguanamine resin particulates, acrylic resin particulates, styrene-acryl copolymer resin particulates, silicon resin particulates, melamine resin particulates, epoxy resin particulates and the like. As the particulate material, other inorganic pigments and organic pigments can also be used.

Although the shape of the particulate material may be any shape so long as the surface of the ink layer can be made uneven, a spherical shape is especially preferable due to its stable performance.

The particulate material is desirably monodispersible in order to enhance the uniformity of the unevenness of the surface of the ink layer, and the particle diameter must be large enough to provide the desired unevenness on the surface of the ink layer. Preferable values for the particle diameter may be different depending on the thickness of the intermediate layer and/or the ink layer and the amount added of the particulate material.

Specifically, the particle diameter of the particulate material is, as the number average particle diameter, preferably 0.5 μm or more and more preferably 0.6~4.0 μm and most preferably 0.8~2.0 μm.

When the number average particle diameter is less than 0.5 μm, the air accumulation is caused when the heat transfer sheet is adhered to the image receiving sheet by vacuum pressure so that transfer unevenness may be caused.

Specific examples of the particulate material include, for example, the spherical silica particulates (1.2 μm), the spherical silica particulates (2.0 μm), the freeshaped silica particulates (1.8 μm), the freeshaped aluminum oxide particulates (1.5 μm), the spherical crosslinking PMMA particulates (1.8 μm), the spherical cross inking PMMA-PS particulates (1.5 μm), MX-150, 180,300 (PMMA particulates manufactured by Soken Chemical & Engineering Co., Ltd.), EPOSTAR S12 (melamine particulates manufactured by Nippon Shokubai Co., Ltd.), EPOSTAR MS (benzoguananiine particulates manufactured by Nippon Shokubai Co., Ltd.), EPOSTAR M30 (melamine/benzoguanarine particulates manufactured by Nippon Shokubai Co., Ltd.), SEAHOSTAR KE-P70, KE-P100, KE-P150 (melamine particulates manufactured by Nippon Shokubai Co., Ltd.) and the like.

If the thickness of the intermediate layer is made thinner, the particulate material tends to protrude from the surface of the intermediate layer. Especially, when the number average particle diameter of the particulate is larger than thickness of the portions of the intermediate layer where no particulate material is present, most of the particulate material contained in the intermediate layer protrudes from the surface of the intermediate layer, which is preferable for forming unevenness efficiently on the surface of the ink layer. The number average particle diameter of the particulate material is larger than the thickness of the portions of the intermediate layer where no particulate material is present by preferably by 0.05 μm~10 μm and more preferably 0.1 μm~5 μm. Of course, even if the number average particle diameter of the particulate material is less than the thickness of the portions of the intermediate layer where no particulate material is present, if the amount added of the particulate material is sufficiently large, the desirable unevenness on the surface of the ink layer can be formed.

The content of the particulate material varies depending on the number average particle diameter of the particulate material, the thickness of the intermediate layer and the like, and is preferably 5~100 mg/m$^2$ and more preferably 5~50 mg/m$^2$.

When the content is 5 mg/m$^2$, there may be a case in which unevenness is not sufficiently formed on the surface of the ink layer. When the content is over 100 mg/m$^2$, the transfer ability of the image is decreased so that the image quality is deteriorated.

It is desirable to make the thickness of the intermediate layer thinner than the number average particle diameter of the particulate material as described above, and specifically, the thickness of the intermediate layer is preferably 0.1~1 μm and more preferably 0.15~0.8 μm.

(Binder)

The intermediate layer having the unevenness-forming-function is formed by dispersing the above-described particulate material and a binder in an appropriate solvent to prepare a coating solution, applying the coating solution to the substrate or a cushion layer which will be described later, and then drying the coating solution. Examples of binders include polymers or copolymers of acrylic monomers such as acrylic acid, cellulose polymers such as cellulose acetate, polystyrene, vinyl polymers such as vinyl chloride/vinyl acetate copolymers, polyvinyl butyral, polyvinyl alcohol and the like, condensed polymers such as polyester, polyamide, polyimide and the like, rubber-based thermoplastic polymers such as butadiene/styrene copolymers, polyurethane, epoxy resin, urea/melamine resin and the like. Among these materials, polymers such as polyvinyl alcohol, polyvinyl butyral, polyester, polyimide and the like are preferably used. Especially preferable binders include the polyimide resin disclosed in Japanese Patent Application No. 10-14092.

2) Material Necessary for Heat-to-Light Conversion Function (Light-to-Heat Conversion Material)

The light-to-heat conversion material usable in the heat transfer sheet of the present invention is not especially limited and any light-to-heat conversion materials which are known conventionally may be used. Conventionally known light-to-heat conversion materials are generally dyes which are able to absorb laser light (i.e., pigments and the like). Examples of such dyes (pigments) include black pigments such as carbon black, pigment of macrocyclic compounds having absorption from the visible range to the near-infrared range such as phthalocyanine, naphthalocyanine, organic dyes used as laser absorbing materials in high density laser recording such as optical discs (cyanine dye, anthraquinone-based dye, azulene-based dye, and phithalocyarune-based dye other than indolenine dye of the present invention), and organometallic compound dyes such as a dithiol/nickel complex. It is desirable that the light-to-heat conversion material has a high light-to-heat conversion capability. Especially preferable light-to-heat conversion materials include the indolenine-based compound disclosed in Japanese Patent Application No. 10-140924 as the general formula (I).

As the amount to be added of the light-to-heat conversion material, when the intermediate layer does not have the unevenness-forming function, the solid weight ratio of the light-to-heat conversion material to the binder is preferably 1:20~2:1 (light-to-heat conversion material: binder) and more preferably 1:10~2:1. However, when the intermediate layer does have the unevenness-forming function, the solid weight ratio of the total amount of the light-to-heat conversion material and the particulate material to the binder (i.e., "light-to-heat conversion material+particulate material": binder) is preferably included in the above ranges. When the amount of the binder is too small, the cohesion of the intermediate layer is decreased and when the formed image is transferred to the image receiving sheet, the intermediate layer is apt to be transferred thereto together with the formed image, which causes color mixing of the image. When the amount of the binder is too large, the thickness of the intermediate layer must be made large in order to attain the desired light absorption coefficient, resulting in a decrease in sensitivity.

When the intermediate layer has the unevenness-forming function, the thickness of the intermediate layer is as explained in the "2) Material Necessary for light-to-Heat Conversion Function" section When the intermediate layer does not have the unevenness-forming function, the thickness of the intermediate layer is preferably 0.03 μm~0.8 μm and more preferably 0.05 μm~0.3 μm. It is preferable that the intermediate layer having the light-to-heat conversion function has a maximum absorbance (optical density) of 0.1~1.3 (more preferably 0.2~1.1) in the wavelength range of 700~2000 nm.

3) Method of Forming Intermediate Layer

The intermediate layer is provided, as described above, by preparing the coating solution in which the particulate material and/or the light-to-heat conversion material and the binder are dissolved, coating the coating solution on the substrate or the cushion layer which will be described later and drying the coating solution. Examples of the solvent for preparing the coating solution include 1,4-dioxane, 1,3-dioxolane, dimethyl acetate, N-methyl-2-pyrrolidone, dimethyl sulfoxide, demethylformamide, dimethylacetoamide, γ-butyrolactone and the like. Coating and drying can be carried out by a general coating and drying method.

Cushion Layer

In the heat transfer sheet of the present invention, it is preferable that the cushion layer is interposed between the substrate and the ink layer or between the substrate and the intermediate layer when the heat transfer sheet has an intermediate layer. By providing the cushion layer on the substrate, bad effects such as waviness of the substrate and the like can be eliminated. At the same time, when the heat transfer sheet and the image receiving sheet are superposed with each other and the image is transferred, the adhesion between the heat transfer sheet and the image receiving sheet can be further improved.

The cushion layer, which can be provided in the heat transfer sheet of the present invention, means a layer with cushioning ability. It is preferable that the cushion layer has 1~250 kg/mm$^2$ of elastic modulus at 25° C. or 15~500 of penetration determined in JIS K2530-1976.

Preferable materials for forming the cushion layer include, for example, ethylene-vinyl acetate copolymer, ethylene-ethyl acrylate copolymer, polybutadiene resin, styrene-butadiene copolymer (SBR), styrentylene-butene-styrene copolymer (SEBS), acrylonitrile-butadiene copolymer (NBR), polyisoprene resin (IR), styrene-isoprene copolymer (SIS), acrylic ester copolymer, polyester resin, polyurethane resin, acrylic resin, butyl rubber, polynorbomene and the like.

Even if the resin alone is not sufficiently cushiony, by adding various additives into the resin, it is possible to ensure the desired cushiony property of the resin and use it as a material for the cushion layer. Examples of the additives include low melting material such as wax and the like, plasticizer and the like. Specifically, the additives include phthalic ester, adipic ester, glycol ester, fatty add ester, phosphoric ester, chlorinated paraffin and the like. Moreover, various additives disdosed in *Practical Handbook of Additives for Plastics and Rubber*, (*Puasuchikku Oyobi Gomu Yo Tenkazai Jitsuyo Ichiran*) (Kagaku Kogyo-Sha (1970)) may be used. The amount to be added of these additives may be appropriately adjusted in accordance with the combination with the resin and the additives and therefore is not especially limited. Generally, the amount to be added of the additives is preferably less than 10% by weight and more preferably less than 5% by weight.

The thickness of the cushion layer is preferably 1~30 μm, more preferably 1~20 μm and most preferably 1~10 μm. When the thickness of the cushion layer is less than 1 μm, the effect provided by the cushion layer cannot be attained, which is not preferable.

The cushion layer can be provided by applying the coating solution, in which the above materials are dissolved or dispersed like latex in an appropriate solvent to the substrate and drying the coating solution Coating and drying can be carried out by a conventional coating and drying method.

Heat Sensitive Peeling Layer

A heat sensitive peeling layer may be provided under the ink layer of the heat transfer sheet of the present invention. The heat sensitive peeling layer includes a heat sensitive material which, by the action of heat from a thermal head or heat generated from the light-to-heat conversion material of the intermediate layer, generates gas or adhesion water or the like so as to weaken the adhesion strength between the ink layer and the substrate or the cushion layer or the intermediate layer. Examples of such heat sensitive materials include a compound which decomposes or degenerates by heat to generate gas (i.e., a polymer or low molecular compound), a compound which absorbs or adsorbs a large amount of easily vaporizable gases such as water or the like, and the like. These compounds may be used in combination.

Examples of polymers which decompose or degenerate by heat to generate gas include auto-oxidizable polymers such as nitrocellulose, halogen-containing polymers such as chlorinated polyolefin, chlorinated rubber, polychlorinated rubber, polyvinyl chloride, polyvinylidene chloride. Examples of compounds which generate adhesion water or the like include acrylic polymer such as polyisobutyl methacrylate into which a volatile compound such as water is adsorbed, cellulose esters such as ethyl cellulose into which a volatile compound such as water is adsorbed, natural polymer compounds such as gelatin into which a volatile compound such as water is adsorbed, and the like. Examples of low molecular polymer compounds which decompose or degenerate by heat to generate gas include compounds which exothermically decompose to generate gas such as diazo compounds and azide compounds. The decomposition and degeneration and the like of the heat sensitive material by heat is preferably carried out below 280° C. and more preferably below 230° C.

When a low molecular compound is used as the heat sensitive material of the heat sensitive peeling layer, the low molecular compound is desirably combined with a binder.

As the binder, not only polymers which themselves decompose or degenerate by heat to generate gas, but also normal polymers which do not have such properties may be used. When a heat sensitive low molecular compound and a binder are used in combination, the weight ratio of the heat sensitive low molecular compound to the binder is preferably 0.02:1~3:1 and more preferably 0.05:1~2:1. It is desirable that the heat sensitive peeling layer coats almost the entire surface of the substrate or the intermediate layer and the thickness thereof is usually 0.03 μm~1 μm and preferably 0.05 μm~0.5μm.

The heat sensitive peeling layer decomposes and degenerates by the action of heat generated from the thermal head or heat generated from the light-to-heat conversion material of the intermediate layer to generate gas. Then, due to this decomposition or generation of gas, the heat sensitive peeling layer is partially eliminated or cohesive failure is generated within the heat sensitive peeling layer so that the bonding strength between the substrate, the cushion layer, or the intermediate layer and the ink layer is decreased. As a result, depending on the action of the heat sensitive peeling layer, a portion thereof adheres to the ink layer and appears on the surface of the finally formed image, and becomes the cause of color mixing in the image. Accordingly, in order to prevent visible color mixing of the formed image being caused, even if his type of transfer of the heat sensitive peeling layer is generated, it is desirable that the heat sensitive peeling layer is almost totally colorless, i.e., exhibits high transparency with respect to visible light Specifically, the light absorption coefficient is preferably less than 50%, and more preferably less than 10% with respect to visible light.

The heat transfer sheet of the present invention may be structured such that instead of providing an independent heat sensitive peeling layer, the intermediate layer coating solution into which the heat sensitive material is added is applied to the substrate or the cushion layer to form an intermediate layer which has both the function of the heat sensitive peeling layer and the function of the intermediate layer.

In the heat transfer sheet of the present invention, the surface of the ink layer is made uneven to a certain degree so as to ensure the vacuum adhesion uniformity with the image receiving sheet, and the particulate material having the function of making the surface of the ink layer uneven is not contained in the ink layer. Therefore, the particulate material does not exist on the surface of the heat transfer sheet, and thus, images with high quality can be formed without problems such as image voids or deterioration of the hue of the image.

In the heat transfer sheet of the present invention, the entire heated ink layer is preferably transferred to the image receiving sheet during heat-transfer. If the intermediate layer having absorption in the visible range is transferred to the sheet, problems such as color impurity and the like may be caused, which is not preferable.

Light-Reflection-Prevention Layer

In the heat transfer sheet in which the intermediate layer having the light-to-heat conversion function is formed, it is preferable that the light-to-heat-reflection-prevention layer is provided on the opposite surface of the substrate to that on which the ink layer is provided. By providing the light-reflection-prevention layer, when the laser light irradiation operation, in which the laser light is irradiated imagewise onto the surface of the heat transfer sheet, is carried out, image turbulence or a decrease in the resolution due to irregular reflection of light can be avoided.

The light-reflection-prevention layer is generally formed by superposing materials having different indexes of reflection so as to obtain the light-reflection-prevention effect and this method is efficient in the present case. Examples of materials having the above effect include sulfides such as SnS, InS, GeS and the like, oxides of In, Sn, Te, Ga, Si, and the like.

Image Receiving Sheet

In order to prevent scratches being formed, on a surface of the ink layer of the heat transfer sheet of the present invention, as occasion demands, a protective cover film (for example, polyethylene terephthalate sheet, polyethylene sheet, or the like) may be superposed thereon or an image receiving sheet may be superposed thereon in advance.

Generally, the image receiving sheet is formed such that on an ordinary sheet-like substrate such as a plastic sheet, a metallic sheet, a glass sheet, a paper or the like, one or two or more image receiving layers are disposed. Examples of the plastic sheet include a polyethylene terephthalate sheet, a polycarbonate sheet, a polyethylene sheet, a polyvinyl chloride sheet, a polyvinylidene chloride sheet, a polystyrene sheet, and a styrene/acrylonitrile copolymer sheet and the like. Examples of the paper include printing paper, coated paper and the like. The thickness of the substrate of the image receiving sheet is usually 10 μm~400 μm, and preferably 25 μm~200 μm. In order to improve adhesion between the substrate and the image receiving layer or between the substrate and the ink layer of the heat transfer sheet, the surface of the substrate may be treated by a glow discharge treatment, a corona discharge treatment or the like.

As mentioned previously, it is preferable to provide one, or two or more image receiving layers on the surface of the substrate in order to facilitate the transfer and fixation of the ink layer of the heat transfer sheet of the present invention to the surface of the image receiving sheet. The image receiving layer is mainly formed from an organic polymer binder. The binder is preferably a thermoplastic resin. Examples of the thermoplastic resin include homopolymers or copolymers of acrylic monomers such as acrylic acid, methacrylic acid, acrylic ester, methacrylic esters and the like, cellulosic polymers such as methyl cellulose, ethyl cellulose, and cellulose acetate, homopolymers and copolymers of vinyl-based monomers such as polystyrene, polyvinylpyrrolidone, polyvinyl butyral, and polyvinyl alcohol and the like, condensed polymers such as polyesters and polyamides, and rubber-based polymers such as butadiene/styrene copolymers. In order to obtain an appropriate adhesive strength between the image receiving layer and the ink layer, the binder of the image receiving layer is preferably a polymer whose glass transition temperature (Tg) is 90° C. or less. Moreover, it is preferable to add a plasticizer to the image receiving layer in order to adjust the glass transition temperature of the image receiving layer.

A laminate of the heat transfer sheet of the present invention and the image receiving sheet is easily obtained by superimposing the ink layer side of the heat transfer sheet and the image receiving side (i.e., the image receiving layer side) of the image receiving sheet with each other and passing them though a press-and-heat roller. In this case, the heating temperature is preferably 130° C. or less, and more preferably 100° C. or less.

Image Forming Process

Next, an image forming process using the heat transfer sheet of the present invention will be described.

Firstly, the ink layer of the heat transfer sheet and the image receiving sheet are placed in contact with each other or extremely close to each other (hereinafter, these materials in such a state are referred to as "an image-forming-laminate"). In the case of a heat transfer sheet in which the intermediate layer having the light-to-heat conversion function is not formed, heat is applied imagewise to the surface of the image-forming-laminate by a thermal head (printing operation), then the image receiving sheet is peeled from the heat transfer sheet to form the image receiving sheet to which the heated region of the ink layer has been transferred. On the other hand, in the case of a heat transfer sheet in which the intermediate layer having the light-to-heat conversion function is formed, laser light is irradiated imagewise onto the surface of the image-forming-laminate in a time series (laser light illumination operation), and thereafter the image receiving sheet is peeled from the heat transfer sheet to obtain the image receiving sheet to which the region subjected to laser light illumination has been transferred.

The printing operation and the laser light illumination operation are usually carried out as follows. Firstly, the image receiving sheet side of the image-forming-laminate is adhered to the surface of a recording drum (which is a rotatable drum with the vacuum-forming mechanism being provided within the interior thereof and a plurality of fine openings being formed at the surface thereof) by vacuum pressure and heat is applied thereto from the outer side, i.e., the heat transfer sheet side, using a thermal head, or alternatively, laser light is irradiated thereon The thermal head or the irradiation of laser light are scanned reciprocally in the transverse direction of the recording drum and the recording drum is rotated at a constant angular velocity during the printing operation or the laser light illumination operation. If the above-described recording drum is not used, the recording may be carried out by scanning on a flat surface using the thermal head or the output head of the laser light.

Examples of the laser light include direct laser lights including gas lasers such as argon ion laser light, helium/neon laser light, helium/cadmium laser light and the like, solid-state laser lights such as YAG laser light and the like, semiconductor laser light, dye laser light, excimer laser light, and the like. Alternatively, light, generated by halving the wavelength of the above-mentioned laser lights through a secondary harmonics element, can also be used. In the image forming method using the heat transfer sheet of the present invention, considering the output power, ease of modulation, and the like, it is preferable to use the semiconductor laser. Further, in the image forming process using the heat transfer sheet of the present invention, the laser light is preferably irradiated such that the beam diameter on the light-to-heat conversion layer is 5~50 $\mu$m (particularly preferably 6~30 $\mu$m). The scanning speed is preferably 1 m/second or greater, and particularly preferably 3 m/second or greater.

The image forming method using the heat transfer sheet of the present invention can be used advantageously not only for forming a black mask or a monochromatic image but also for forming a multicolor image.

Namely, in a first aspect of the method of forming a multicolor image, the following steps are carried out Firstly, the image receiving material is fixed on a rotating drum of a recording apparatus by the vacuum reduced pressure method, and the heat transfer material is Laminated on the image receiving material by the vacuum reduced pressure method such that an image receiving layer of the image receiving material and an image recording layer (hue 1) of the heat transfer material contact each other. Next, laser light modulated on the basis of digital signals of a color-separated image of the original image is irradiated from the substrate side of the heat transfer material while the drum is rotated. Thereafter, the heat transfer material is peeled from the image receiving material with the image receiving material being fixed on the drum. On the image receiving material on which the image of hue 1 has been recorded, heat transfer materials of hues 2,3, and, if necessary, 4 are laminated, subjected to laser recording and peeled by the same method as the above-described method, consecutively. In this way, an image receiving material on which a multicolor image is formed can be obtained.

In order to obtain a color proof image on printing paper, the following steps are carried out. The image receiving material on which a multicolor image has been formed by the above-described steps is laminated such that the image surface thereof contacts a printing paper. Then, the image receiving material and the printing paper are passed through a laminator or the like, heated and pressed, and the printing paper is peeled from the heat transfer image receiving material so that the image is transferred to the printing paper together with the image receiving layer.

In a second aspect of the method of forming the multicolor image, the following steps are carried out In a second aspect of the method of forming the multicolor image, a laminate is prepared for each color by laminating a heat transfer material having an ink layer which contains a coloring agent representing the hue of that color with an image receiving material. In a case of a three-color image, for example, three laminates are required, and in a case of four-color image, four laminates are required. Laser light is irradiated on each of the laminates on the basis of digital signals of the color image corresponding to the laminate obtained via a color separation filter. Thereafter, the heat transfer material is peeled from the image receiving material in each laminate. Color-separated images of respective colors are independently formed on the respective heat transfer image receiving materials, and thereafter, each of color-separated images is successively transferred on the actual substrate, such as a separately prepared printing paper or the like or a similar substrate, so that the image is formed.

EXAMPLES

The present invention will be described in detail with reference to examples hereinafter, however, the present invention is not limited to the examples below. Note that, provided that it is not stated otherwise, in the examples, "part" means "part by weight". Note also that, in the examples and the comparative examples, "particulate material" means "the particulate material having the function of making the surface of the ink layer uneven" as described above.

Example 1

1) Preparation of Intermediate Layer Coating Solution

The respective components shown in the composition of the coating solution below were mixed while being stirred by a stirrer and the mixture was subjected to dispersing treatment in a paint shaker (manufactured by Toyo Seiki Seisaku-Sho, Ltd.) for 1 hour to prepare the intermediate layer coating solution

| [Composition of Coating Solution] | |
|---|---|
| Light-to-heat conversion material (NK-2014 manufactured by Nippon Kankoh-Shikiso Kenkyusho Co., Ltd.; infrared light absorbing dye) | 10 parts |
| Binder (Rikacoat SN-20 manufactured by New Japan Chemical Co., Ltd.) | 200 parts |
| N-metyl-2-pyrolidone | 2000 parts |
| Surfactant (Megafac F-177 manufactured by Dainippon Ink and Chemicals Inc.) | 1 part |
| Particulate material (MX 150 manufactured by Soken Chemical & Engineering Co., Ltd.; PMMA particle having a number average particle diameter of 1.5 μm) | 6 parts |

2) Formation of the Intermediate Layer on the Surface of the Substrate

The above intermediate layer coating solution was applied to one surface of the substrate (an A4-size-polyethylene terephthalate film having a thickness of 75 μm) by a rotating coating device (wheeler), then the coated substrate was dried for 2 minutes in an oven at 100° C. to form the intermediate layer having the light-to-heat conversion function on the substrate.

The resultant intermediate layer had maximum absorption at about 830 nm in a wavelength range of 700 nm~1000 nm. The absorbance (optical density: OD) measured by the Macbeth densitometer was OD=1.08. Upon observing a cross-section of the intermediate layer by a scanning electron microscope, the thickness of the portions of the intermediate layer where no particulate material was present was found to be 0.3 μm on average. Calculating from the amount of coating, the solid density and the thickness of the intermediate layer, the amount of the particulate material in the intermediate layer was 60 mg/m$^2$.

3) Preparation of Yellow Ink Layer Coating Solution

The respective components shown in the composition of a pigment dispersed mother liquor below were subjected to dispersing treatment in a paint shaker (manufactured by Toyo Seisaku-Sho, Ltd.) for 2 hours, then glass beads were removed therefrom to prepare a yellow pigment dispersed mother liquor.

| [Composition of Pigment-Dispersed Mother Liquor] | |
|---|---|
| a 20% by weight-solution of polyvinyl butyral (Denka Butyral #200-L having a Vicat softening point of 57° manufactured by Denki Kagaku Kogyo Kabushiki Kaisha) | 12.6 parts |
| Coloring material (Yellow pigment (C.I. pigment yellow 14)) | 24 parts |
| Dispersing aid (Solsperse S-20000 manufactured by ICI Japan Ltd.) | 0.8 parts |
| n-propyl alcohol | 110 parts |
| Glass beads | 100 parts |

The respective components shown in the composition of the coating liquid below were mixed while being stirred by the stirrer to prepare the yellow ink layer coating solution.

| [Composition of Coating Solution] | |
|---|---|
| Yellow pigment dispersed mother liquor described above | 20 parts |
| n-propyl alcohol | 60 parts |
| Surfactant (Megafac F-176PF manufactured by Dainippon Ink and Chemicals Inc.) | 0.05 parts |

4) Formation of the Ink Layer on the Surface of the Intermediate Layer

The above-mentioned ink layer coating solution was applied to the surface of the substrate on the side on which the intermediate layer had been formed by the wheeler for 1 minute, then the coated substrate was dried for 2 minutes in an oven at 100° C. to form a yellow ink layer (pigment 64.2% by weight, polyvinyl butyral: 33.7% by weight) on the intermediate layer. The absorbance of the resultant ink layer (the optical density: OD) measured by the Macbeth densitometer was 0.7. The thickness of the ink layer measured by the same manner as that of the intermediate layer was 0.4 μm on average. With the above steps, a heat transfer sheet in which the intermediate layer and the ink layer were disposed in that order on the substrate was prepared. The 10-point mean surface roughness (Rz) of the surface of the ink layer of the resultant heat transfer sheet measured by a surfcom 570A 3DF (manufactured by Tokyo Seimitsu Co., Ltd.) was 1.90 μm.

<Formation of the Image Receiving Sheet>

1) Preparation of the First Image Receiving Layer Coating Solution

The respective components shown in the composition of the coating solution below were mixed while being stirred by a stirrer to prepare the first image receiving layer coating solution.

| [Composition of Coating Solution] | |
|---|---|
| Vinyl chloride/vinyl acetate copolymer (MPR-TSL manufactured by Nisshin chemicals) | 25 parts |
| Dibutyloctylphthalate (DOP manufactured by Daihachi Chemicals) | 12 parts |
| Surfactant (Megafac F-177 manufactured by Dainippon Ink and Chemicals Inc.) | 4 parts |
| Solvent (Methyl ethyl ketone) | 75 parts |

2) Formation of the First Image Receiving Layer on the Surface of the Substrate

After applying the above first image receiving coating solution one surface of the substrate (i.e., the A4-size-polyethylene terephthalate film having a thickness of 100 μm) by the wheeler, the coated substrate was dried for 2 minutes in the oven at 100° C. As a result, the first image receiving layer (having the thickness of 20 μm) was formed on the substrate.

3) Preparation of the Second Image Receiving Layer Coating Solution

The respective components shown in the composition of the coating solution below were mixed while being stirred by the stirrer to prepare the second image receiving coating solution.

| [Composition of the Coating Solution] | |
|---|---|
| Polyvinylbutyral (Denkabutyral #2000-L manufactured by Denki Kagaku Kogyo Kabushiki Kaisha) | 16 parts |
| N,N-dimethylacrylamide/butylacrylate copolymer | 4 parts |
| Surfactant (Megafac F-177 manufactured by Dainippon Ink and Chemicals Inc.) | 0.5 parts |
| Solvent (n-propyl alcohol) | 200 parts |

4) Formation of the Second Image Receiving Layer on the Surface of the First Image Receiving Layer The above second image receiving layer coating solution was applied to the surface of the substrate on the side on which the above first image receiving layer had been formed by the wheeler, the coated substrate was dried for 2 minutes in the oven at 100° C. to form the second image receiving layer having the thickness of 2 μm on the first image receiving layer. As a result, with the above steps, the image receiving sheet, with two image receiving layers being superposed, was prepared on the substrate.

<Image Forming>

The laminate for image-forming was formed by the following steps. First, the image receiving sheet was placed on a rotational drum in which a plurality of suction openings were formed for vacuum suction such that the image receiving sheet substrate side was contacted with the surface of the rotational drum. Respective heat transfer sheets obtained by Examples 1~5 and Comparative Examples 1~4 (including sheets which will be described later) were placed on and wound onto the roller, respectively so that each surface of the heat transfer sheet on the side on which the ink layer had been formed was contacted with the image receiving sheet (image receiving layer side) and a vacuum was created in the interior of the rotational drum. As a result, two sheets were fixed to the surface of the rotational drum and the image-forming-laminate was formed. (Although the example was structured as described above, the image-forming-laminate may be formed by pre-laminating the two sheets using a pressure and heat roller in advance.). The laser image recording on the image-forming-laminate was carried out by the following steps. Firstly, the rotational drum was rotated and then the semiconductor laser light having a wavelength of 830 nm was focused onto the surface of the image-forming-laminate placed on the rotational drum such that the semiconductor laser light became a spot having a diameter of 7 μm on the surface of the intermediate layer. The spot was moved orthognally (sub-scanning) with respect to the rotational direction of the rotational drum (main-scanning direction). Conditions for laser illumination were as follows.

Laser power: 110 mW

Main scanning speed: 4 m/second

Sub-scanning pitch (amount of subscanning per rotation): 20 μm

The image-forming-laminate subjected to the above laser image recording was removed from the rotational drum, the image receiving sheet was peeled from the heat transfer sheet As a result, the image on the image receiving sheet was formed.

The above-described operations were carried out on 6 kinds of image-forming-laminates obtained by the above processes so as to form images corresponding to evaluation points which will described later.

<Evaluation>

1) Image-Forming Ability

A solid image obtained by the laser image recording was transferred to Tokuryo Art Paper (manufactured by Mitsubishi Paper Mills Limited.) by a laminator CA680 TIII (manufactured by Fuji Photo Film Co., Ltd.) to form a solid image A. Only the ink layer of the heat transfer sheet was transferred to the Tokuryo Art Paper by the same laminator to form a solid image B. Image densities of respective solid images A and B were measured by the Macbeth densitometer at 10 arbitrary points thereof and the average of the density values was taken. Then the transfer rate (%) was calculated by the following formula;

The transfer rate (%)=(the density of the solid image A)/(the density of the solid image B)×100

The images were evaluated by evaluating the transfer rate in accordance with the criteria below. The results are shown in Table 1.

○: a transfer rate of 80% or more

Δ: a transfer rate of 50% or more and less than 80%

X: a transfer rate of less than 50%

2) Transfer Voids

In the images obtained by the laser image recording, the image voids probably due to non-transfer of the coloring material were evaluated by the following criteria. The results are shown in Table 1.

○: no image voids or image voids having the size of less than 20 μm

Δ: image voids having the size of 20 μm or more and less than 50 μm

X: image voids having the size of 50 μm or more

3) Air Accumulation

In the images obtained by the laser image recording, non-transfers of the coloring material probably due to air accumulation between the image receiving sheet and the heat transfer sheet were visually evaluated by the following criteria. The results are shown in Table 1.

○: no non-transfer probably due to air accumulation

Δ: non-transfer probably due to air accumulation at a central portion of the image X: non-transfer probably due to air accumulation over all of the image 4) Image Hue The image obtained by the laser image recording was re-transferred to Tokuryo Art Paper (manufactured by Mitsubishi Paper Mills Limited) by using a CA680 TIII laminator (manufactured by Fuji Photo Film Co., Ltd.). The reflection density of the image after transfer was measured by using the X-rite 938 (manufactured by X-rite), and the hue at the time that the reflection density was 1.81 was measured. The hue after the measurement and the hue of a color sample of printed matter were compared and the difference therebetween ΔE was used as an indicator of the image hue. The smaller the ΔE, the better the hue. Results are shown in Table 1.

Example 2

A heat transfer sheet in which the intermediate layer and the ink layer were disposed in that order on the substrate was prepared in the same manner as that of Example 1 except that SEAHOSTAR KEP 100 (manufactured by Nippon Shokubai Co., Ltd., silica particle having a number average particle diameter of 1.0 μm) was employed as the particulate material in the intermediate layer coating layer.

The absorbance (optical density: OD) of the intermediate layer, the thickness of the portions of the intermediate layer where no particulate material was present, the absorbance (optical density: OD) of the ink layer, and the thickness of the ink layer were measured in the same manner as in Example 1 and all resultant values were the same as those of Example 1.

The amount of the particulate material in the intermediate layer measured in the same manner as that of Example 1 was 60 mg/m$^2$. The 10-point mean surface roughness (Rz) of the surface of the ink layer of the resultant heat transfer sheet measured in the same manner as that of Example 1 was 1.53 $\mu$m.

In the same manner as that of Example 1, an image was formed by using the resultant heat transfer sheet and the image receiving sheet formed in Example 1. The image forming ability (the sensitivity) of the formed image, image voids, air accumulation and the image hue were evaluated by the same methods as those of Example 1. The results of evaluation are shown in the following Table 1.

Example 3

A heat transfer sheet in which the intermediate layer and the ink layer were disposed in that order on the substrate was prepared in the same manner as that of Example 1 except that Tospearl 120 (manufactured by Toshiba Silicone Co., Ltd., silicone resin, having a number average particle diameter of 1.54 $\mu$m) was used as the particulate material in the intermediate layer coating solution.

The absorbance (optical density: OD) of the intermediate layer, the thickness of the portions of the intermediate layer where no particulate material was present, the absorbance (optical density: OD) of the ink layer, and the thickness of the ink layer were measured in the same manner as in Example 1 and all resultant values were the same as those of Example 1.

The amount of the particulate material in the intermediate layer measured in the same manner as that of Example 1 was 60 mg/m$^2$. The 10-point mean surface roughness (Rz) of the surface of the ink layer of the resultant heat transfer sheet measured in the same manner as that of Example 1 was 1.25 $\mu$m.

In the same manner as that of Example 1, an image was formed by using the resultant heat transfer sheet and the image receiving sheet formed in Example 1. The image forming ability (the sensitivity) of the formed image, image voids, air accumulation and the image hue were evaluated by the same methods as those of Example 1. The results of evaluation are shown in the following Table 1.

Comparative Example 1

A heat transfer sheet in which the intermediate layer and the ink layer were disposed in that order on the substrate was prepared in the same manner as that of Example 1 except that the added amount of the particulate material in the intermediate layer coating solution was changed from 6 parts to 60 parts.

The absorbance (optical density: OD) of the intermediate layer, the thickness of the portions of the intermediate layer where no particulate material was present, the absorbance (optical density: OD) of the ink layer, and the thickness of the ink layer were measured in the same manner as in Example 1 and all resultant values were same as those of Example 1.

The amount of the particulate material in the intermediate layer measured in the same manner as that of Example 1 was 60 mg/m$^2$. The 10-point mean surface roughness (Rz) of the surface of the ink layer of the resultant heat transfer sheet measured in the same manner as that of Example 1 was 5.52 $\mu$m.

In the same manner as that of Example 1, an image was formed by using the resultant heat transfer sheet and the image receiving sheet formed in Example 1. The image forming ability (the sensitivity) of the formed image, image voids, air accumulation and the image hue were evaluated by the same methods as those of Example 1. The results of evaluation are shown in the following Table 1.

Comparative Example 2

A heat transfer sheet, in which the intermediate layer and the ink layer were disposed in that order on the substrate, was prepared in the same manner as that of Example 1 except that the added amount of the particulate material in the intermediate layer coating solution was changed from 6 parts to 0.1 parts.

The absorbance (optical density: OD) of the intermediate layer, the thickness of the portions of the intermediate layer where no particulate material was present, the absorbance (optical density: OD) of the ink layer, and the thickness of the ink layer were measured in the same manner as in Example 1 and all resultant values were the same as those of Example 1.

The amount of the particulate material in the intermediate layer measured in the same manner as that of Example 1 was 1 mg/m$^2$. The 10-point mean surface roughness (Rz) of the surface of the ink layer of the resultant heat transfer sheet measured in the same manner as that of Example 1 was 0.38 $\mu$m.

In the same manner as that of Example 1, an image was formed by using the resultant heat transfer sheet and the image receiving sheet formed in Example 1. The image forming ability (the sensitivity) of the formed image, image voids, air accumulation and the image hue were evaluated by the same methods as those of Example 1. The results of evaluation are shown in the following Table 1.

Comparative Example 3

The heat transfer sheet, in which the intermediate layer and the ink layer were disposed in that order on the substrate, was prepared in the same manner as that of Example 1 except that the particulate material was not added into the intermediate layer coating solution.

The absorbance (optical density: OD) of the intermediate layer, the thickness of the intermediate layer, the absorbance (optical density: OD) of the ink layer, and the thickness of the ink layer were measured in the same manner as in Example 1 and all resultant values were the same as those of Example 1.

The 10-point mean surface roughness (Rz) of the surface of the ink layer of the resultant heat transfer sheet measured in the same manner as that of Example 1 was 0.25 $\mu$m.

In the same manner as that of Example 1, an image was formed by using the resultant heat transfer sheet and the image receiving sheet formed in Example 1. The image forming ability (the sensitivity) of the formed image, image voids, air accumulation and the image hue were evaluated by the same methods as those of Example 1. The results of evaluation are shown in the following Table 1.

Example 4

The heat transfer sheet was prepared in the same manner as that of Comparative Example 1. The surface of the heat transfer sheet was embossed to form unevenness on the surface thereof.

The absorbance (optical density: OD) of the intermediate layer, the thickness of the intermediate layer, the absorbance (optical density: OD) of the ink layer, and the thickness of the ink layer were measured in the same manner as in Example 1 and all resultant values were the same as those of Example 1.

The 10-point mean surface roughness (Rz) of the surface of the ink layer of the resultant heat transfer sheet measured in the same manner as that of Example 1 was 1.69 μm.

In the same manner as that of Example 1, an image was formed by using the resultant heat transfer sheet and the image receiving sheet formed in Example 1. The image forming ability (the sensitivity) of the formed image, image voids, air accumulation and the image hue were evaluated by the same methods as those of Example 1. The results of evaluation are shown in the following Table 1.

Comparative Example 4

The heat transfer sheet, in which the intermediate layer and the ink layer had been formed in that order on the substrate, was prepared in the same manner as that of Example 1 except that 1.8 parts of SEAHOSTAR KEP 100 (silica particle having a number average particle diameter of 1.0 μm, manufactured by Nippon Shokubai Co., Ltd.) was added into the pigment dispersing mother liquor for forming the ink layer as the particulate material, and the particulate material was not added to the intermediate layer coating solution.

Note that the absorbance (optical density: OD) of the intermediate layer, the thickness of the intermediate layer, the absorbance (optical density: OD) of the ink layer, and the thickness of the ink layer measured by the same manner as in Example 1 were all the same values as those of Example 1.

The amount of the particulate material in the ink layer calculated by the thickness, the added amount and the solid density of the ink layer was 60 mg/m$^2$. The 10-point mean surface roughness (Rz) of the surface of the ink layer of the heat transfer sheet, which was measured by the same manner as that of Example 1, was 1.41 μm.

In the same manner as that of Example 1, an image was formed by using the resultant heat transfer sheet and the image receiving sheet formed in Example 1. The image forming ability (the sensitivity) of the formed image, image voids, air accumulation and the image hue were evaluated by the same methods as those of Example 1. The results of evaluation are shown in the following Table 1.

Example 5

1) Preparation of Cushion Layer Coating Solution

A cushion layer coating solution having the composition of coating solution below was prepared by mixing while being stirred with a stirrer.

| [Composition of Coating Solution] | |
|---|---|
| Copolymer of ethylene and ethylacrylate (Evaflex A-709 manufactured by Mitsui Petrochemical Industries, Ltd.) | 20 parts |
| Solvent (toluene) | 100 parts |

2) Formation of the Cushion Layer on the Surface of the Substrate

The above cushion layer coating solution was applied to one surface of the substrate (which was an A4-size polyethylene terephthalate film having the thickness of 75 μm) by a rotating coating device (wheeler). Thereafter, the coated substrate was dried for 2 minutes in an oven at 100° C. to form a cushion layer having a thickness of 5 μm on the substrate.

3) Formation of the Intermediate Layer and Ink Layer

The intermediate layer and the ink layer were formed at the surface of the substrate on the side on which the cushion layer had been formed by the same manner as that of Example 1.

Note that the absorbance (optical density: OD) of the intermediate layer, the thickness of the intermediate layer, the absorbance (optical density: OD) of the ink layer, and the thickness of the ink layer measured by the same manner as in of Example 1 were all same values as those of Example 1.

The 10-point mean surface roughness (Rz) of the surface of the ink layer of the resultant heat transfer sheet, which was measured by the same manner as that of Example 1, was 1.73 μm.

In the same manner as that of Example 1, an image was formed by using the resultant heat transfer sheet and the image receiving sheet formed in Example 1. The image forming ability (the sensitivity) of the formed image, image voids, air accumulation and the image hue were evaluated by the same methods as those of Example 1. The results of evaluation are shown in the following Table 1.

TABLE 1

| | Particulate Material | | | | | | | |
|---|---|---|---|---|---|---|---|---|
| | Intermediate Layer [μm] | Ink Layer [μm] | Content [mg/m$^2$] | Rz Value [μm] | Image Forming Ability | Transfer Voids | Air Accumulation | ΔE |
| Example 1 | 1.5 | — | 60 | 1.9 | ○ | ○ | ○ | 1.56 |
| Example 2 | 1.0 | — | 60 | 1.53 | ○ | ○ | ○ | 1.42 |
| Example 3 | 1.54 | — | 60 | 1.25 | ○ | ○ | ○ | 1.61 |
| Example 4 | Embossing | | — | 1.69 | ○ | ○ | ○ | 1.09 |
| Example 5 | 1.5 | — | 60 | 1.73 | ○ | ○ | ○ | 1.74 |
| Comparative Example 1 | 1.5 | — | 600 | 5.52 | x | ○ | ○ | 3.56 |
| Comparative Example 2 | 1.5 | — | 1 | 0.38 | Δ | Δ | Δ | 1.01 |
| Comparative Example 3 | — | — | — | 0.25 | Δ | x | Δ | 0.93 |

TABLE 1-continued

| | Particulate Material | | | | | | | |
|---|---|---|---|---|---|---|---|---|
| | Intermediate Layer [μm] | Ink Layer [μm] | Content [mg/m²] | Rz Value [μm] | Image Forming Ability | Transfer Voids | Air Accumulation | ΔE |
| Comparative Example 4 | — | 1.0 | 60 | 1.41 | ○ | ○ | ○ | 3.31 |

As shown in Table 1, in heat transfer sheets of Examples 1~5, sufficient adhesion without air accumulation was obtained. Moreover, it was possible to form superior transferred images with high sensitivity, high image density, and without image deficiencies such as transfer voids and non-transfer due to air accumulation. The hue of the image was stable and excellent. When forming the laminate, it was possible to apply a vacuum at high speed.

In the heat transfer sheet of Example 5 where the cushion layer was provided, the image hue ΔE was 5% higher than that of the heat transfer sheet of Example 1 where no cushion layer was provided. Further, transfer voids were not observed at all in the heat transfer sheet of Example 5.

In contrast, in the heat transfer sheets of Comparative Examples 1~3, the 10-point mean surface roughness (Rz value) of the surfaces of the ink layers were not included in the range prescribed by the present invention. Adhesion was poor and images with high sensitivity and without image deficiencies were not able to be obtained (Comparative Example 1), and transfer voids and non-transfer due to air accumulation were caused so that images with high sensitivity and high image quality were not able to be obtained (Comparative Examples 2 and 3). In Comparative Examples 1 and 4, image hues were not sufficiently obtained, and especially, in the case of adding the particulate material to the ink layer such as in Comparative Example 4, a predetermined surface property (Rz value) was exhibited but the image hue was inferior.

Example 6

<Forming of Heat Transfer Sheet>

Preparation of Intermediate Layer Coating Solution

The respective components of the following composition of the particulate material dispersion A were subjected to dispersing treatment for 2 hours in a paint shaker (manufactured by Toyo Seiki Seisaku-Sho, Ltd.), by using 15 g of glass beads each of which had a diameter of 0.5 mm, to prepare the particulate material dispersion A.

| [Composition of Particulate Material Dispersion A] | |
|---|---|
| Particulate Material (silica particulates, number average particle diameter: 1.5 μm) (SEAHOSTAR KE-P150 manufactured by Nippon Shokubai Co., Ltd.) | 2.5 g |
| Methyl ethyl ketone | 22.0 g |
| Dispersing aid (Solsperse S-20000 manufactured by ICI Japan Ltd.) | 0.5 g |

The respective components of the following composition of the coating solution were mixed while being stirred by a stirrer, and the mixture was subjected to dispersing treatment in a paint shaker (manufactured by Toyo Seiki Seisaku-Sho, Ltd.) for 1 hour to prepare the intermediate layer coating solution.

| [Composition of Coating Solution] | |
|---|---|
| Light-to-heat conversion material (infrared light absorbing dye) (NK-2014 manufactured by Nippon Kankoh-Shikiso Kenkyusho Co., Ltd.) | 0.8 g |
| Binder (Rikacoat SN-20 manufactured by New Japan Chemical Co., Ltd.) | 15 g |
| N-methyl-2-pyrolidone | 135 g |
| Methyl ethyl ketone | 35 g |
| Surfactant (Megafac F-177 manufactured by Dainippon Ink and Chemicals Inc.) | 0.1 g |
| Particulate material dispersion A | 1.5 g |

The resultant intermediate layer coating solution was applied to one surface of the substrate (a biaxial oriented polyethylene terephthalate film having a thickness of 75 μm) by a rotating coating device (wheeler), and then the coated substrate was dried for 2 minutes in an oven at 100° C. to form on the substrate the intermediate layer having a light-to-heat conversion function.

The resultant intermediate layer had maximum absorption at about 830 nm in a wavelength range of 700~1000 nm. The absorbance (optical density: OD) measured by a Macbeth densitometer was OD=1.05. Observing a cross-section of the intermediate layer by a scanning electron microscope, it was noted that the thickness of the portions of the intermediate layer where no particulate material was present was 0.4 μm on average.

The amount of the particulate material in the intermediate layer was found to be 40 mg/m² by calculation using the amount of coating, the concentration of solids and the thickness of the intermediate layer.

Preparation of Ink Layer Coating Solution (1)

The respective components of the following composition of a pigment dispersed mother liquor, were subjected to dispersing treatment for 2 hours in a paint shaker (manufactured by Toyo Seiki Seisaku-Sho, Ltd.), by using 15 g of glass beads each of which had a diameter of 0.5 mm to prepare a cyan pigment dispersed mother liquor.

| [Composition of Cyan Pigment Dispersed Mother Liquor] | |
|---|---|
| Cyan pigment (#700-10FG manufactured by Toyo Ink Mfg. Co., Ltd.) | 15 g |
| Polyvinyl butyral (BL-SH manufactured by Denki Kagaku Kogyo Kabushiki Kaisha) | 15 g |
| Dispersing aid (PW-36 manufactured by Kusumoto Chemicals, Ltd.) | 0.75 g |
| n-propyl alcohol | 120 g |

The respective components of the following composition of a coating solution were mixed while being stirred by a stirrer to prepare a cyan ink layer coating solution (1).

| [Composition of Coating Liquid] | |
|---|---|
| Cyan pigment dispersed mother liquor | 30 g |
| n-propyl alcohol | 200 g |
| Methyl ethyl ketone | 60 g |
| Wax (behenic acid) | 0.5 g |
| Wax (stearic acid) | 0.5 g |
| Wax (behenic acid amide) | 0.5 g |
| Rosin (KE 311 manufactured by Arakawa Chemical Industries, Ltd.) | 0.7 g |
| Polyvinyl butyral (BL-SH manufactured by Denki Kagaku Kogyo Kabushiki Kaisha) | 1.3 g |
| Surfactant (Megafac F-176PF manufactured by Dainippon Ink and Chemicals Inc.) | 0.5 g |

The resultant cyan ink layer coating solution (1) was applied to the intermediate layer formed on the substrate by a wheeler for 1 minute, and then the coated substrate was dried for 2 minutes in an oven at 100° C. to form a cyan ink layer (pigment: 64.2% by weight, polyvinyl butyral: 33.7% by weight) on the intermediate layer. The absorbance (optical density:OD) of the cyan ink layer measured by a Macbeth densitometer (cyan) was OD=0.7. The thickness of the ink layer measured in the same manner as in the case of the intermediate layer was 0.4 $\mu$m on average.

By carrying out the above-described steps, the heat transfer sheet of the present invention, in which the intermediate layer and the ink layer were provided in that order on the substrate, was formed.

The 10-point mean surface roughness (Rz) of the surface of the ink layer of the resultant heat transfer sheet as measured by Surfcom 570A 3DF (manufactured by Tokyo Seimitsu Co., Ltd.) was 1.83 $\mu$m.

<Evaluation>

In the same manner as in Example 1, an image was formed by using the resultant heat transfer sheet and the image receiving sheet formed in Example 1. The image forming ability (transfer rate) of the formed image was evaluated by the same method as that of Example 1. The results of evaluation are shown in Table 7.

Further, the image obtained by laser image recording was evaluated with respect to the following points.

5) Transfer Unevenness of Image

In the image obtained by laser image recording, the state of transfer unevenness caused by inferior transfer of the coloring material was evaluated in accordance with the following criteria. The results are shown in Table 7.

○: no transfer unevenness in the image so that an image with high quality was obtained Δ: a slight amount transfer unevenness, but of a level which would not present problems in actual use X: noticeable transfer unevenness was observed 6) Adhesion Resistance Humidity conditioning of the resultant heat transfer sheet of the present invention was carried out under a temperature of 25° C. and a relative humidity of 65%RH. Then, the heat transfer sheet was cut into pieces having a size of 5 cm×5 cm to form a plurality of sheet pieces. These sheet pieces were laminated such that the surface of the ink layer thereof and the surface of the substrate at the side at which no ink layer was provided were contacted. Next, a load of 500 g was applied to the respective laminated sheet pieces. In his state, the sheet pieces were allowed to stand for 3 days under a temperature of 50° C. and a relative humidity of 75%RH. Thereafter, the degree of sticking of the sheet pieces was visually evaluated in accordance with following criteria. The results are shown in Table 7.

○: no sticking between sheet pieces

Δ: a slight amount of sticking at end portions of sheet pieces

X: sticking at central portions of sheet pieces

Examples 7~13

Heat transfer sheets of the present invention were formed in the same manner as that of Example 6 except that, instead of the particulates used in Example 6, the particulates shown in the following Table 2 were used.

TABLE 2

| | Kind of Particulate Material |
|---|---|
| Example 7 | SEAHOSTAR KE-P100 (manufactured by Nippon Shokubai Co., Ltd.; silica particulates) |
| Example 8 | SEAHOSTAR KE-P70 manufactured by Nippon Shokubai Co., Ltd.; silica particulates) |
| Example 9 | EFOSTAR S12 (manufactured by Nippon Shokubai Co., Ltd.; melamine particulates) |
| Example 10 | EPOSTAR MS (manufactured by Nippon Shokubai Co., Ltd.; benzoguanamine particulates) |
| Example 11 | MX-150 (manufactured by Soken Chemical & Engineering Co., Ltd.; PMMA particulates) |
| Example 12 | MX-180 (manufactured by Soken Chemical & Engineering Co., Ltd.; PMMA particulates) |
| Example 13 | Tospearl 120 (manufactured by Toshiba Silicone Co., Ltd.; silicone particulates) |

The absorbance (optical density: OD) of the intermediate layer, the thickness of the intermediate layer, the absorbance (optical density: OD) of the ink layer and the thickness of the ink layer were measured in the same manners as in Example 6, and the resultant values for each of Examples 7 through 13 were all the same as those of Example 6. The amount of the particulate material in each of the intermediate layers of Examples 7 through 13 was found to be 40 mg/m$^2$ by calculating by using the amount of coating, the concentration of solids, and the thickness of the intermediate layer.

The 10-point mean surface roughness (Rz) of the surfaces of the ink layers of the resultant heat transfer sheets were measured in the same manner as that of Example 1, and the results are shown in Table 7.

In the same manner as in Example 1, images were formed by using the respective resultant heat transfer sheets and the image receiving sheet formed in Example 1. The image forming abilities (transfer rates) of the respective formed images were evaluated by the same method as that of Example 1. Transfer unevenness and the adhesion resistance were evaluated by the same methods as those of Example 6. The results of evaluation are shown in Table 7.

Examples 14~16

Heat transfer sheets of the present invention were formed in the same manner as that of Example 6, except that the content of the particulate material used in Example 6 was changed such that the content of the particulate material in the ink layer after coating became the content shown in the following Table 3.

TABLE 3

| | Amount of Particulate Material Used [mg/m$^2$] |
|---|---|
| Example 14 | 10 |
| Example 15 | 20 |
| Example 16 | 80 |

The absorbance (optical density: OD) of the intermediate layer, the thickness of the intermediate layer, the absorbance (optical density: OD) of the ink layer and the thickness of the ink layer were measured in the same manner as in Example 6, and all of the resultant values of Examples 14 through 16 were the same as those of Example 6. The amount of the particulate material of the intermediate layer of each of Examples 14 through 16 was found to be 40 mg/m$^2$ by calculating by using the amount of coating, the concentration of solids, and the thickness of the intermediate layer.

The 10-point mean surface roughness (Rz) of the surfaces of the ink layers of the resultant heat transfer sheets were measured in the same manner as that of Example 1, and the results are shown in Table 7.

In the same manner as in Example 1, images were formed by using the respective resultant heat transfer sheets and the image receiving sheet formed in Example 1. The image forming abilities (transfer rates) of the respective formed images were evaluated in the same manner as that of Example 1. Transfer unevenness and the adhesion resistance were evaluated in the same manner as in Example 6. The results of evaluation are shown in Table 7.

Examples 17~19

Heat transfer sheets of the present invention were formed in the same manner as that of Example 6 except that instead of the cyan ink layer coating solution (1) prepared in Example 6, the ink layer coating solutions shown in the following Table 4 were used.

TABLE 4

| | Type of Coating Solution |
|---|---|
| Example 17 | Ink Layer Coating Solution (2) |
| Example 18 | Ink Layer Coating Solution (3) |
| Example 19 | Ink Layer Coating Solution (4) |

Compositions of the respective ink layer coating solutions in the above Table 4 are listed below. Ink layer coating solutions (2)~(4) were prepared by using the method of preparing the ink layer coating solution (1) of Example 1.

| [Composition of Ink Layer Coating Solution (2)] | |
|---|---|
| Cyan pigment dispersed mother liquor prepared in Example 6 | 30 g |
| n-propyl alcohol | 200 g |
| Methyl ethyl ketone | 60 g |
| Wax (behenic acid) | 0.25 g |
| Wax (stearic acid) | 0.25 g |
| Wax (behenic acid amide) | 0.25 g |
| Rosin (KE 311 manufactured by Arakawa Chemical Industries, Ltd.) | 0.9 g |
| Polyvinyl butyral (BL-SH manufactured by Denki Kagaku Kogyo Kabushiki Kaisha) | 1.5 g |
| Surfactant (Megafac F-176PF manufactured by Dainippon Ink and Chemicals Inc.) | 0.5 g |

-continued

| [Composition of Ink Layer Coating Solution (3)] | |
|---|---|
| Cyan pigment dispersed mother liquor prepared in Example 6 | 30 g |
| n-propyl alcohol | 200 g |
| Methyl ethyl ketone | 60 g |
| Wax (behenic add) | 0.7 g |
| Wax (stearic acid) | 0.7 g |
| Wax (behenic add amide) | 0.7 g |
| Rosin (KE 311 manufactured by Arakawa Chemical Industries, Ltd.) | 0.5 g |
| Polyvinyl butyral (BL-SH manufactured by Denki Kagaku Kogyo Kabushiki Kaisha) | 1.5 g |
| Surfactant (Megafac F-176PF manufactured by Dainippon Ink and Chemicals Inc.) | 0.5 g |

| [Composition of Ink Layer Coating Solution (4)] | |
|---|---|
| Cyan pigment dispersed mother liquor prepared in Example 6 | 30 g |
| n-propyl alcohol | 200 g |
| Methyl ethyl ketone | 60 g |
| Wax (behenic acid) | 1.0 g |
| Wax (stearic acid) | 1.0 g |
| Wax (behenic acid amide) | 1.0 g |
| Rosin (KF 311 manufactured by Arakawa Chemical Industries, Ltd.) | 0.5 g |
| Polyvinyl butyral (BL-SH manufactured by Denki Kagaku Kogyo Kabushiki Kaisha) | 1.5 g |
| Surfactant (Megafac F-176PF manufactured by Dainippon Ink and Chemicals Inc.) | 0.5 g |

The absorbance (optical density: OD) of the intermediate layer, the thickness of the intermediate layer, the absorbance (optical density: OD) of the ink layer and the thickness of the ink layer were measured in the same manner as in Example 6, and all of the resultant values of each of Examples 17 through 19 were the same as those of Example 6. The amount of the particulate material in the intermediate layer of each of Examples 17 through 19 was found to be 40 mg/m$^2$ by calculating from the amount of coating, the concentration of solids, and the thickness of the intermediate layer.

The 10-point mean surface roughness (Rz) of the surfaces of the ink layers of resultant heat transfer sheets were measured by the same manner as that of Example 1 and results will be shown in Table 7.

In the same manner as in Example 1, images were formed by using respective resultant heat transfer sheets and the image receiving sheet formed in Example 1. The image forming abilities (transfer rates) of the respective formed images were evaluated in the same manner as in Example 1. Transfer unevenness and adhesion resistance were evaluated in the same way as in Example 6. The results of evaluation are shown in Table 7.

Comparative Examples 5~7

Heat transfer sheets were formed in the same way as in Example 6 except that instead of the particulate material used in Example 6, the particulate materials shown in the following Table 5 were used.

TABLE 5

| | Type of Particulate Material | Number Average Particle Diameter [μm] |
|---|---|---|
| Comparative Example 5 | not used | — |
| Comparative Example 6 | SEAHOST AR KE-P30 (manufactured by Nippon Shokubai Co., Ltd.; silica particulates) | 0.3 |
| Comparative Example 7 | SNOWTEX DMAC-ST-ZL (manufactured by Nissan Chemical Industries, Ltd.; colloidal silica) | 0.08 |

The absorbance (optical density: OD) of the intermediate layer, the thickness of the intermediate layer, the absorbance (optical density: OD) of the ink layer and the thickness of the ink layer were measured in the same manners as in Example 6, and all resultant values for each of Comparative Examples 5 through 7 were the same as those of Example 6. The amount of the particulate material in each of the intermediate layers of Comparative Examples 5 through 7 was found to be 40 mg/m$^2$ by calculating by using the amount of coating, the concentration of solids and the thickness of each of the intermediate layer.

The 10-point surface average roughness (Rz) of the surfaces of the ink layers of the resultant heat transfer sheets were measured by the same method as that of Example 1 and the results are shown in Table 7.

In the same manner as in Example 1, images were formed by using respective resultant heat transfer sheets and the image receiving sheet formed in Example 1. The image forming abilities (transfer rates) of respective formed images were evaluated in the same way as in Example 1. Transfer unevenness and adhesion resistance were evaluated by the same methods as those of Example 6. The results of evaluation are shown in Table 7.

Comparative Examples 8 and 9

Heat transfer sheets were formed in the same manner as in Example 6 except that instead of the cyan ink layer coating solution (1) prepared in Example 6, ink layer coating solutions shown in the following Table 6 were used.

TABLE 6

| | Type of Coating Solution |
|---|---|
| Comparative Example 8 | Ink Layer Coating Solution (5) |
| Comparative Example 9 | Ink Layer Coating Solution (6) |

Compositions of the respective ink layer coating solutions in the above Table 6 are listed below. The ink layer coating solutions (5) and (6) were prepared by using the method of preparing the ink layer coating solution (1) of Example 1.

| [Composition of Ink Layer Coating Solution (5)] | |
|---|---|
| Cyan pigment dispersed mother liquor prepared in Example 6 | 30 g |
| n-propyl alcohol | 200 g |
| Methyl ethyl ketone | 60 g |
| Rosin | 0.7 g |

-continued

| [Composition of Ink Layer Coating Solution (5)] | |
|---|---|
| (KE 311 manufactured by Arakawa Chemical Industries, Ltd.) | |
| Polyvinyl butyral | 1.3 g |
| (BL-SH manufactured by Denki Kagaku Kogyo Kabushiki Kaisha) | |
| Surfactant | 0.5 g |
| (Megafac F-176PF manufactured by Dainippon Ink and Chemicals Inc.) | |

| [Composition of Ink Layer Coating Solution (6)] | |
|---|---|
| Cyan pigment dispersed mother liquor prepared in Example 6 | 30 g |
| n-propyl alcohol | 200 g |
| Methyl ethyl ketone | 60 g |
| Wax (behenic acid) | 1.8 g |
| Wax (stearic acid) | 1.8 g |
| Wax (behenic acid amide) | 1.8 g |
| Rosin | 0.7 g |
| (KE 311 manufactured by Arakawa Chemical Industries, Ltd.) | |
| Polyvinyl butyral | 1.3 g |
| (BL-SH manufactured by Denki Kagaku Kogyo Kabushild Kaisha) | |
| Surfactant | 0.5 g |
| (Megafac F-176PF manufactured by Dainippon Ink and Chemicals Inc.) | |

The absorbance (optical density: OD) of the intermediate layer, the thickness of the intermediate layer, the absorbance (optical density: OD) of the ink layer and the thickness of the ink layer were measured in the same manner as in Example 6 and the resultant values of Comparative Examples 8 and 9 were all the same as those of Example 6. The amount of the particulate material in the intermediate layer of each of Comparative Examples 8 and 9 was found to be 40 mg/m$^2$ by calculating by using the amount of coating, the concentration of solids and the thickness of the intermediate layer.

The 10-point mean surface roughness (Rz) of the surfaces of the ink layers of the resultant heat transfer sheets were measured by the same method as that of Example 1 and the results are shown in Table 7.

In the same manner as in Example 1, images were formed by using the respective resultant heat transfer sheets and the image receiving sheet formed in Example 1. The image forming abilities (transfer rates) of the respective formed images were evaluated in the same manner as in Example 1. Transfer unevenness and adhesion resistance were evaluated in the same manner as in Example 6. The results of evaluation are shown in Table 7.

TABLE 7

| | Particulate Material | | | | | | |
|---|---|---|---|---|---|---|---|
| | Number Average Particle Diameter [μm] | Content [mg/m²] | Wax/Amorphous Organic Polymer (W/P ratio) | Rz Value [μm] | Transfer Rate [%] | Transfer Unevenness | Adhesion Resistance |
| Example 6 | 1.5 | 40 | 34.9/100 | 1.83 | 97 | ○ | ○ |
| Example 7 | 1 | 40 | 34.9/100 | 0.94 | 95 | ○ | ○ |
| Example 8 | 0.7 | 40 | 34.9/100 | 0.74 | 96 | ○ | ○ |
| Example 9 | 1.2 | 40 | 34.9/100 | 1.04 | 96 | ○ | ○ |
| Example 10 | 2 | 40 | 34.9/100 | 2.25 | 98 | ○ | ○ |
| Example 11 | 1.5 | 40 | 34.9/100 | 1.88 | 96 | ○ | ○ |
| Example 12 | 1.8 | 40 | 34.9/100 | 2.03 | 97 | ○ | ○ |
| Example 13 | 2 | 40 | 34.9/100 | 2.22 | 95 | ○ | ○ |
| Example 14 | 1.5 | 10 | 34.9/100 | 1.77 | 95 | ○ | ○ |
| Example 15 | 1.5 | 20 | 34.9/100 | 1.82 | 96 | ○ | ○ |
| Example 16 | 1.5 | 80 | 34.9/100 | 1.85 | 95 | ○ | ○ |
| Example 17 | 1.5 | 40 | 17.5/100 | 1.88 | 92 | ○ | ○ |
| Example 18 | 1.5 | 40 | 48.8/100 | 1.92 | 97 | ○ | ○ |
| Example 19 | 1.5 | 40 | 69.8/100 | 1.88 | 98 | ○ | ○ |
| Comparative Example 5 | — | 0 | 34.9/100 | 0.16 | 92 | x | Δ |
| Comparative Example 6 | 0.3 | 40 | 34.9/100 | 0.23 | 90 | Δ | ○ |
| Comparative Example 7 | 0.08 | 40 | 34.9/100 | 0.18 | 92 | x | Δ |
| Comparative Example 8 | 1.5 | 40 | 0/100 | 1.96 | 78 | Δ | ○ |
| Comparative Example 9 | 1.5 | 40 | 125.6/100 | 1.88 | 97 | ○ | x |

From results of the above Table 7, it can be seen that in the heat transfer sheets of Examples 6~19 where the intermediate layer containing the particulate material and the ink layer containing the wax were provided, adhesion was sufficiently obtained without air accumulation, and images with high sensitivity, high image density, superior hue, high quality and without image deficiencies such as transfer unevenness and the like were able to be obtained. Further, the adhesion resistance was superior so that images without image deficiencies were able to be obtained stably. In Examples 9~13 where organic particulates were used as the particulate material, a more stable intermediate layer coating solution was obtained than the solution obtained in the case of using other particulate materials, and a heat transfer material with stable quality was easily obtained.

Further, when the laminate was formed, it was possible to apply vacuum at high speed.

On the other hand, in the heat transfer materials of Comparative Examples 5~7 where a particulate material having the diameter prescribed in the present invention was not used in the intermediate layer, non-transfer due to air accumulation and inferior transfer were caused so that images with high image density and high quality were not able to be obtained. Also, sufficient adhesion resistance was not obtained. In the heat transfer materials of Comparative Examples 8 and 9 where wax was not used in the amount prescribed in the present invention, the transfer property or the adhesion resistance was poor so that images with high sensitivity and high quality were not able to be stably obtained.

According to the present invention, it is possible to provide a heat transfer sheet in which vacuum adhesion uniformity between the heat transfer sheet and an image receiving sheet at the time of heat-transfer can be ensured and an image with high sensitivity, high image density, good hue, and high quality and without image deficiencies such as transfer unevenness and the like can be formed without a particulate material which may affect the image quality being used in the ink layer.

According to the present invention, it is possible to provide a heat transfer sheet in which foreign matter such as dust and the like can be prevented from entering in between the heat transfer sheet and the image receiving sheet, and image deficiencies due to deformation of the heat transfer sheet and/or the image receiving sheet can be avoided.

What is claimed is:

1. A heat transfer sheet comprising:

a substrate; and an ink layer which is provided on the substrate and contains a pigment and an amorphous organic polymer;

wherein said ink layer is structured such that without using particulate material, having the function of forming unevenness on the surface of said ink layer, in said ink layer, a 10-point mean surface roughness (Rz) of the surface of said ink layer is 0.5~5.0 μm.

2. The heat transfer sheet according to claim 1, wherein an intermediate layer, containing particulate material having the function of forming unevenness on the surface of the ink layer, is provided between said substrate and said ink layer.

3. The heat transfer sheet according to claim 1, further comprising an intermediate layer provided between said substrate and said ink layer, said intermediate layer comprising particulate material, wherein the thickness of portions of said intermediate layer where no particulate material is present, is smaller than the average particle diameter of the particulate material.

4. The heat transfer sheet according to claim 1, further comprising an intermediate layer provided between said substrate and said ink layer, said intermediate layer comprising particulate material, wherein the average particle diameter of the particulate material is 0.5 μm or more.

5. The heat transfer sheet according to claim 1, wherein the ink layer contains a wax, and the weight ratio(W:P) of the content of the wax (W) to the content of the amorphous organic polymer (P) in the ink layer is 5:100~100:100.

6. The heat transfer sheet according to claim 1, further comprising an intermediate layer provided between said substrate and said ink layer, said intermediate layer comprising particulate material wherein the average particle diameter of the particulate material is 0.6~4 $\mu$m.

7. The heat transfer sheet according to claim 1 further comprising an intermediate layer provided between said substrate and said ink layer, said intermediate layer comprising particulate material wherein the content of the particulate material in the intermediate layer is 5~100 mg/m$^2$.

8. The heat transfer sheet according to claim 1, further comprising an intermediate layer provided between said substrate and said ink layer, said intermediate layer comprising particulate material wherein the particulate material is organic particulates.

9. The heat transfer sheet according to claim 1, wherein the entire heated ink layer is transferred during heat-transfer.

10. The heat transfer sheet according to claim 1 further comprising an intermediate layer provided between said substrate and said ink layer, wherein said intermediate layer contains material having a light-to-heat conversion function.

11. The heat transfer sheet according to claim 1, further comprising an intermediate layer provided between said substrate and said ink layer, wherein a cushion layer is disposed between said substrate and said intermediate layer.

12. The heat transfer sheet according to claim 11, wherein the thickness of said cushion layer is 1~30 $\mu$m.

13. The heat transfer sheet according to claim 1, further comprising:

an intermediate layer provided between said substrate and said ink layer; and a heat sensitive peeling layer provided between said ink layer and said intermediate layer, wherein said heat sensitive peeling layer comprises heat sensitive material which emits at least one of gas and water due to action of heat so as to weaken the adhesive strength between said ink layer and said intermediate layer.

* * * * *